US005482057A

United States Patent [19]

Bushmaker

[11] Patent Number: 5,482,057

[45] Date of Patent: Jan. 9, 1996

[54] NAIL POLISHING WAND

[76] Inventor: Mikel J. Bushmaker, 1104 Town Crest Rd., Williamsport, Pa. 17701

[21] Appl. No.: 230,715

[22] Filed: Apr. 21, 1994

[51] Int. Cl.[6] ..... A45D 29/00

[52] U.S. Cl. ..... 132/73; 248/205.5

[58] Field of Search ..... 132/73, 73.5; 211/105.1, 211/123; 248/205.5

[56] References Cited

U.S. PATENT DOCUMENTS 4,696,316 9/1987 Stanley ..... 132/73

*Primary Examiner*—John G. Weiss

[57] ABSTRACT

A support for retaining and polishing artificial fingernails, comprising a cylinder, having one diameter convenient for a handle, a second diameter approximately the curvature of an artificial thumbnail and of sufficient size to hold at least one set of thumbnails, a third diameter approximately the curvature of an artificial fingernail and of sufficient size to hold at least one set of artificial fingernails, a suction cup affixed to the handle end of the device for standing the device on end, and two tape rolls, sticky side out with perforations for removal of one layer of tape at a time, that friction fit the cylinder intended for retaining the artificial thumbnails and fingernails.

2 Claims, 3 Drawing Sheets

NAIL POLISHING WAND

FIELD OF THE INVENTION

The invention is a device for supporting artificial fingernails for purposes of polishing, drying, maintenance and storage.

BACKGROUND OF THE INVENTION

Artificial fingernails are generally accepted and widely used among women and young ladies in our society. In their common usage, the artificial fingernails are first applied over the natural fingernails and then polished or painted. There are long standing drawbacks to this application of artificial fingernails in that most people are not ambidextrous and therefore have trouble doing a quality job of polishing, painting or trimming the artificial fingernails when the application is done on their dominant hand by their non-dominant hand. Secondly, when polishing or painting artificial fingernails while in place on one's fingers, polish gets on cuticles and skin leaving a less than professional or natural appearance. Thirdly, it takes a considerable amount of time to polish one's fingernails and once polished, it takes another 1 to 2 hours drying time. During the drying time period, the wearer is practically immobile so as not to smudge or otherwise damage the finish on the nails. Fourth, because it takes so much time to polish fingernails, it is often inconvenient to do them just before wearing them. By utilizing the nail polishing wand, a person can do a wide variety of nails in different lengths and colors well ahead of the time of their intended use. You can also select the right color for the clothes you are intending to wear. A further use of my nail polishing wand is that when applying designs to fingernails, it would be much easier to do so with the nails on my nail polishing wand than when the nails are already applied to the fingers. My nail polishing wand allows one the use of both hands, thereby giving a more professional look. These can also be significant monetary savings to a person using my nail polishing wand, because it allows a professional looking manicure that would otherwise cost between $45 to $100 if done by a professional. The nail polishing wand can also be effectively used in the professional environment as a display tool to advertise custom designs or as a means for early preparation of artificial fingernails for regularly scheduled customers; thereby saving time for the customer and allowing the technician to see more customers in a given day.

SUMMARY OF THE INVENTION

In order to achieve the objective of the invention, the single piece wand would have three cylindrical surfaces, one of which would approximate the curvature of a fingernail and of such length as to accommodate at least one set of fingernails; the second cylindrical surface approximately the size of a person's thumbnail and of sufficient length to accommodate at least one set of thumbnails; the third cylindrical surface would function as a handle and of sufficient size to be held comfortably in one hand by an average adult person. The two smaller cylindrical surfaces would have tape, sticky side out, preferably on a roll that could be slipped over the cylindrical surface for a friction fit with the tape perforated such that a layer at a time could be easily removed. Lastly, a suction cup would be affixed to the outside end of the largest cylindrical surface enabling the nail polishing wand to be stood on end, without falling over, for long periods of time for purposes of drying, painting or storing the artificial fingernails.

DETAILED DESCRIPTION OF THE PREFERRED EMBODIMENTS

Figure 1:
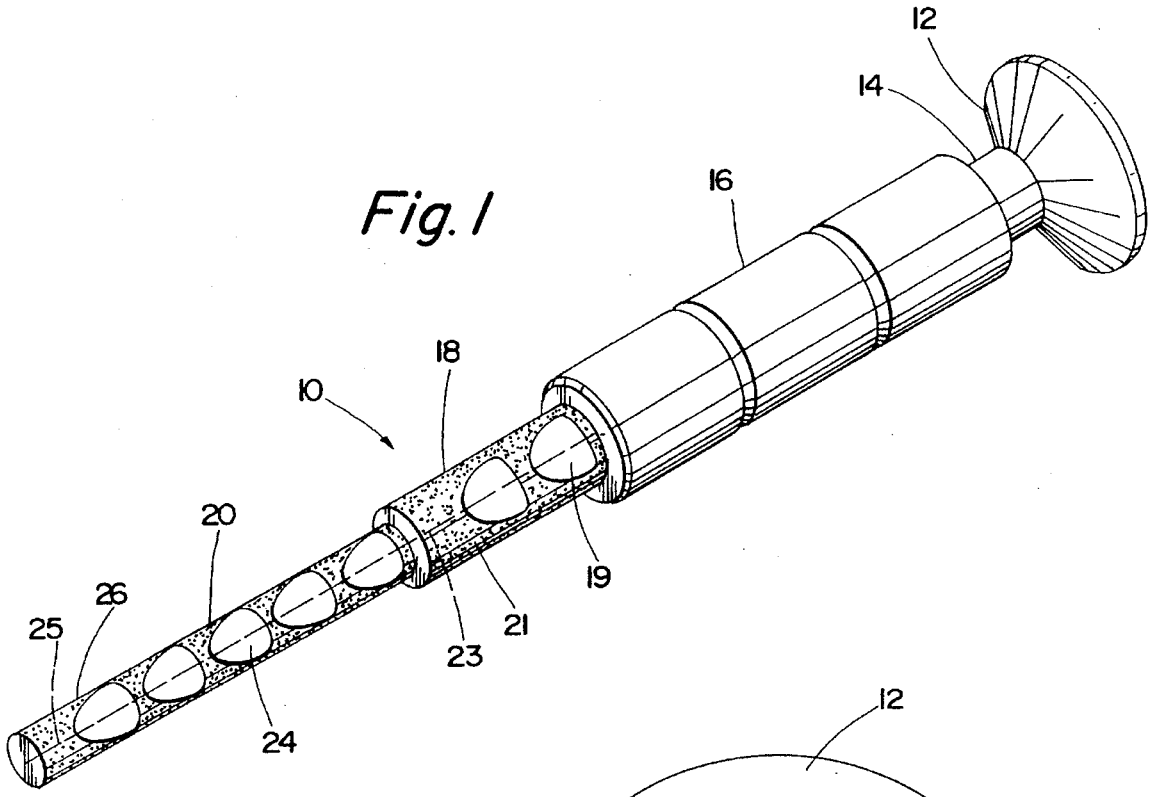
FIG. 1 shows a perspective view of the nail polishing wand device.
Figure 2:
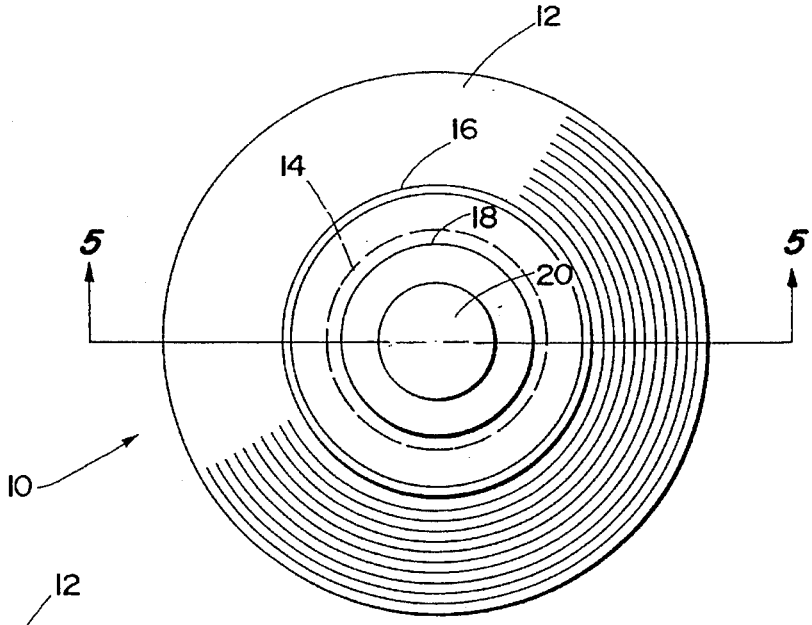
FIG. 2 is a top view of the device.
Figure 3:
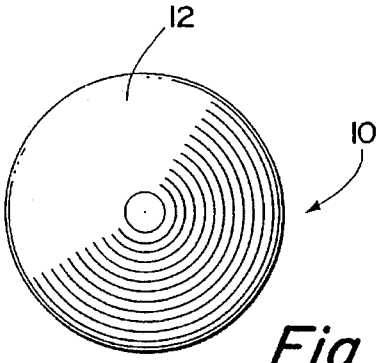
FIG. 3 is a bottom view of the device.

The preferred embodiments of the present invention designated by reference numeral 10, is illustrated in FIG. 1. The base 12 is a suction cup affixed to the blunt end of the cylindrical handle 16 at the neck end 14 of the suction cup. Affixed to the handle 16, opposite end of the suction cup, preferably molded thereto, is a smaller cylinder 18, approximately the curvature of artificial thumbnails 19 and having a tape roll 21, sticky side out with perforations 23 for removal of one layer of tape at a time, friction fit over said cylinder 18 for the purpose of adhering the artificial thumbnails 19 thereto while polishing, displaying, storing or otherwise awaiting use. Affixed to cylinder 18, preferably molded thereto, is a smaller yet cylinder 20; approximately the curvature of artificial fingernails 24 and having a second tape roll 26, sticky side out with perforations 25 for removal of one layer of tape at a time, friction fit over said cylinder 20 for the purpose of adhering the artificial fingernails 24 thereto while polishing, displaying, storing or otherwise awaiting use.

Figure 4:
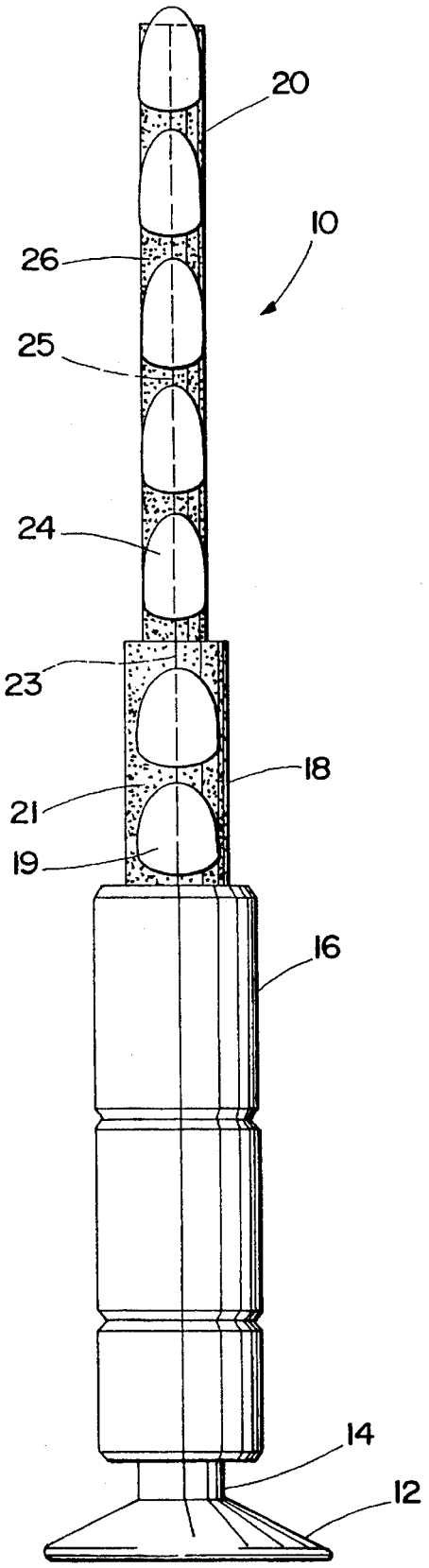
FIG. 4 is a side view of the device.

As shown in side view FIG. 4, cylinder 20 is long enough to accommodate at least one set of artificial fingernails and preferably two sets while cylinder 18 is long enough to accommodate at least one set of thumbnails and preferably two sets.

Figure 5:
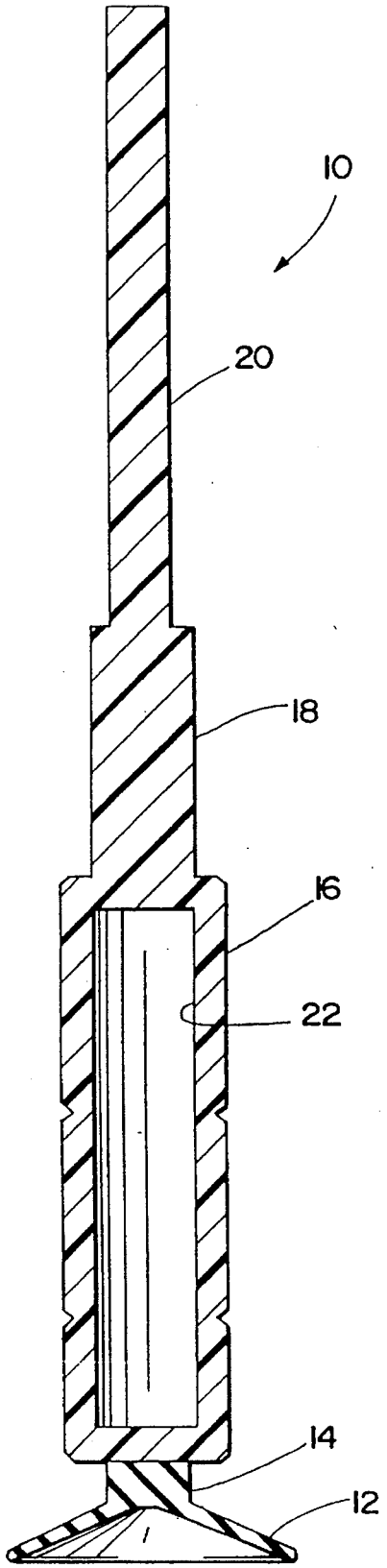
FIG. 5 is a sectional view along line 5—5 of FIG. 2.

FIG. 5 shows an alternate means of manufacture of the present invention 10 having a hollow core handle 22 for lighter weight and less materials usage.

Figure 6:
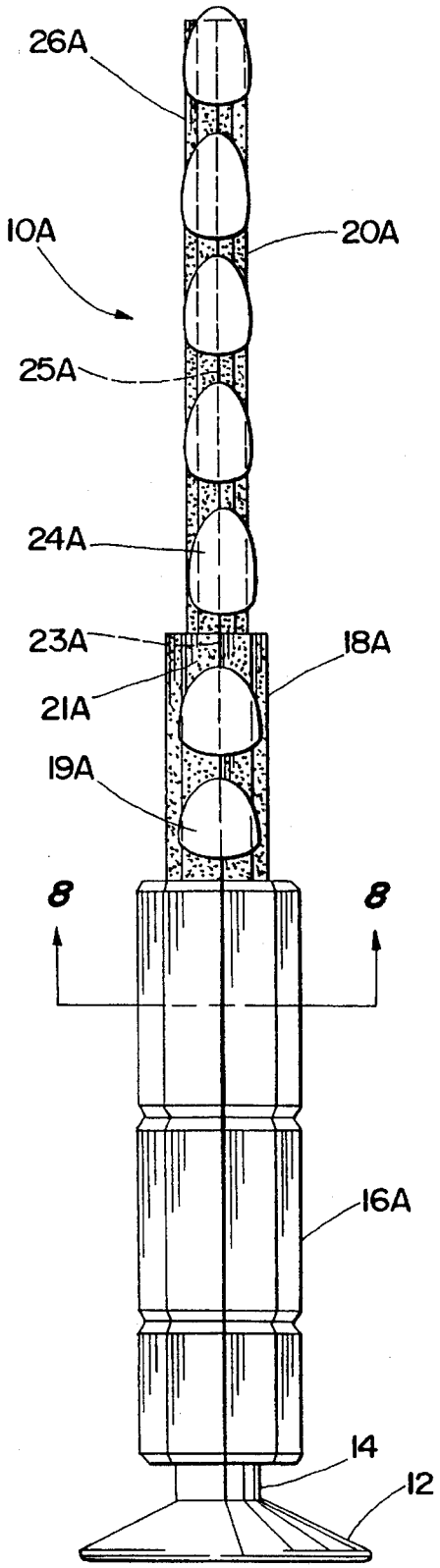
FIG. 6 is a side view of alternative version being, octagonally shaped.
Figure 7:
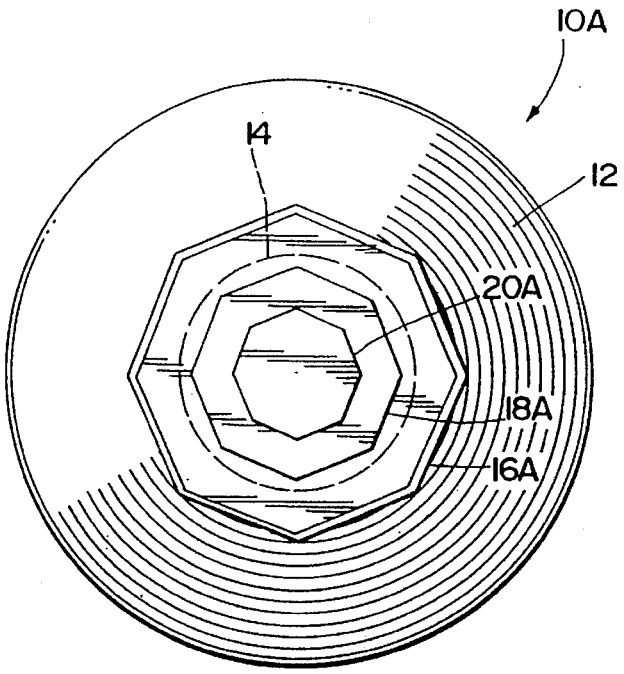
FIG. 7 is a plan or top view of an alternate octagonal shape.

FIG. 6 shows an alternative design 10A having octagonal shapes to the handle 16A and taped cylinders, sticky side out, 18A and 20A should greater friction be required to hold tape rolls onto said cylinders 18A and 20A.

Figure 8:
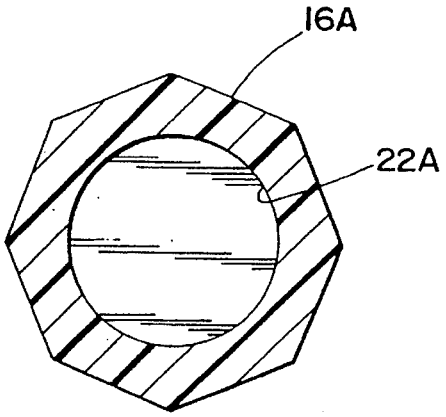
FIG. 8 is a cross sectional view of FIG. 6.

FIG. 8 is a cross-sectional view of FIG. 6 having octagonal shapes to the handle 16A and a hollow core handle 22A.

What is claimed is:

1. A device, capable of being stood on end, for retaining artificial fingernails while polishing, displaying or storing the artificial fingernails comprising:

a cylinder having three diameters along its length, one diameter suitable for a handle, a second diameter of sufficient size to hold at least one set of artificial thumbnails, a third diameter of sufficient size to hold at least one set of artificial fingernails; a suction cup affixed to a base end of said cylinder suitable for a handle; two tape rolls, sticky side out for adhering the fingernails to and with perforations for removal of one layer of tape at a time, friction fit over the cylinders dimensioned to receive the fingernails and which tape rolls after wearing out, one layer at a time, can easily be replaced with new tape rolls.

2. The device in claim 1 wherein said device is made of molded plastic.

* * * * *